United States Patent [19]

Andersen

[11] Patent Number: 4,516,736

[45] Date of Patent: May 14, 1985

[54] METHOD AND APPARATUS FOR SLITTING METAL STRIP

[75] Inventor: Poul Andersen, Wallingford, Conn.

[73] Assignee: Allegheny Ludlum Steel Corporation, Pittsburgh, Pa.

[21] Appl. No.: 440,151

[22] Filed: Nov. 8, 1982

[51] Int. Cl.[3] ..... B65H 35/02

[52] U.S. Cl. ..... 242/56.2; 83/76; 83/494

[58] Field of Search ..... 242/56.2, 56.6, 56.7, 242/56.9, 75.51; 83/76, 74, 494

[56] References Cited

U.S. PATENT DOCUMENTS

| | | | |
|---|---|---|---|
| 1,355,104 | 10/1920 | Cameron et al. . | |
| 2,251,282 | 8/1941 | Huizeng | 164/65 |
| 3,276,647 | 10/1966 | Lewis, Jr. et al. | 83/76 X |
| 3,471,099 | 10/1969 | Albert | 242/75.51 |
| 3,674,221 | 7/1972 | Riemersma | 242/75.51 |
| 3,712,554 | 1/1973 | Lorenzini et al. | 242/56.2 |
| 3,762,663 | 10/1973 | Nedreski | 242/75.51 |
| 3,803,959 | 4/1974 | Rung | 83/18 |
| 3,853,279 | 12/1974 | Gerstein | 242/56.2 |
| 3,884,427 | 5/1975 | Hashimoto et al. | 242/56.2 |
| 4,052,599 | 10/1977 | Whiteley et al. | 242/75.51 X |

FOREIGN PATENT DOCUMENTS 2554817 6/1977 Fed. Rep. of Germany ..... 83/76

*Primary Examiner*—John M. Jillions
*Attorney, Agent, or Firm*—Patrick J. Viccaro

[57] ABSTRACT

A method and apparatus for longitudinally slitting metal strip under tension is provided. The method includes driving the strip forward and controlling the speed thereof through frictional engagement with the strip and slitting the strip under tension while further driving the strip, winding coils of slit strip while still further driving the strip and measuring the speed of the strip before slitting, the speed of slitting and the speed of winding the coils of slit strip and controlling those speeds as a function of the driving speed for providing a predetermined tension during slitting and for winding tighter coils of metal strip. An apparatus is also provided which includes a driven roll means before the slitter, a slitting means which is driven and a take-up winder means which is driven, as well as speed controls for slitting the strip under tension in order to provide tightly wound coils of slit metal strip ranging from light to heavy gauge.

8 Claims, 1 Drawing Figure

METHOD AND APPARATUS FOR SLITTING METAL STRIP

BACKGROUND OF THE INVENTION

This invention relates to a method and apparatus for longitudinally slitting metal strip. More particularly, this invention relates to slitting light or heavy gauge strip material under tension to wind tighter and larger coils of slit strip material.

Generally, slitting of light gauge metal is accomplished with known techniques using zero tension through the slitter. Such devices provide for a loop of strip material before and after the slitter and a driven slitter having knives which transport the strip material through the slitter as part of the operation. A problem associated with slitting metal strip under zero tension is that tight coils of slit strip cannot readily be wound on the take-up winder or reel. Through the use of "slip cores" in the take-up winder and through specially-adapted bridle roll arrangements, this problem has been alleviated; however, there is still the problem of unequal loops of slit material between the slitter and winding reel.

The problem of unequal loops of slit material results from any differential speeds of the individual strips slit from the strip material. Unequal loops may result from overrolled and thus thinner gauge strip at the edges of the unslit strip. The problem is particularly acute for lighter gauge metal strip. Smaller diameter edge coils result in differential speeds of individual strips which form unequal loops of slit material. Under extreme conditions, unequal loops can have a differential of several hundred feet and require a looping pit of impractical depth.

By slip cores, it is meant that the take-up winder includes individual friction discs mounted on a winder shaft. Friction pressure is provided through a hydraulic cylinder controlled with variable hydraulic pressure to provide the desired tension. The slit material strips are attached to individual friction discs (or slip cores) which allow relative motion between individual coils. Such slip cores used with slitting metal strip are presently available from Strouss Industries, Inc.

Tighter coils of strip material can be produced by placing the strip under tension during windup and/or slitting. It is known, however, that pull-through slitting of strip material is not practical because of the mechanical drag of the slitter and the minimal contact between the slitter knives and the metal strip material. Known techniques for slitting material under tension are shown in the patent art. U.S. Pat. No. 1,355,104, issued Oct. 5, 1920, discloses a slitting machine primarily for paper which uses a driven roller to draw paper through shears at a constant speed. One of the slitting members is driven and frictionally drives a seccnd slitting member.

U.S. Pat. No. 2,251,282, issued Aug. 5, 1941, relates to a machine to slit or cut ribbons from a fabric web pulled under tension through the cutters for the purpose of eliminating drag on the fabric at the point of cutting. Shafts or rolls located after the cutters control the advance of the fabric through the cutters, as well as drive the cutters.

U.S. Pat. No. 3,803,959, issued Apr. 16, 1974, discloses a belt slitting apparatus which slits primarily elastic material under tension or stretching and provides adjustable tension longitudinally through feed and guide rolls. The apparatus includes driven supply and take-up rolls and driven feed rolls before the slitter and driven guide rolls after the slitter. Reversibility of the supply and take-up rolls is used to stretch and control the tension of the material at any given time.

There is a need for a method and apparatus for winding tight coils of slit metal strip materials of light or heavy gauge. It is desirable that the slit metal strip be put under tension while being wound. Furthermore, an objective is for slitting of the metal strip under tension and coil winding under tension without the problems of the prior art, such as by eliminating the problem of unequal loops of slit material. A method and apparatus which can provide a more efficient, less complicated and faster slitting operation and which can solve the deficiencies of the prior devices is an objective.

SUMMARY OF THE INVENIION

In accordance with the present invention, an apparatus is provided for longitudinally slitting metal strip which may range from light to heavy gauge. The apparatus includes a driven roll means for frictionally engaging and forwarding the strip while controlling the speed of the strip through the entire apparatus. The apparatus also includes a means for slitting the strip under tension where the means is located after the driven roll means and the speed of the slitting means is controlled through the driven roll means. The apparatus also includes a take-up winder means for winding coils of slit metal strip at a speed controlled through the driven roll means. A means for driving each of the driven roll means, slitting means and take-up winder means is provided. The apparatus includes a means for measuring the speed of the strip, the slitting means and the take-up winder means and a means for controlling the speed of the strip, the slitting means and the take-up winder means through communication with the driven roll means for providing a predetermined speed of the strip as it passes through the slitting means under tension and for winding tighter coils of slit strip on the take-up winder. The means for controlling the speed may include tachometer-generators and pulse generatcrs. The driven roll means may include a two-roll bridle.

A method is also provided for longitudinally slitting the strip comprising providing metal strip, driving the strip forward and controlling the speed thereof by frictional engagement therewith, slitting the strip under tension while further driving the strip and winding coils of slit strip while still further driving the strip. The method includes measuring the speed of the strip before slitting, measuring the speed of slitting and the speed of winding the coils of slit strip and thereby controlling the driving speed of the strip before slitting the strip and thereafter controlling the speed of slitting and winding the strip as a function of the driving speed for providing a predetermined tension during slitting.

The present invention provides a method and apparatus for winding tight coils of slit metal strip and as a result, providing coils which can be larger and more easily handled because they are tightly wound. Furthermore, the present invention may be limited only by the capacity of the take-up winder and the slip cores used therein.

BRIEF DESCRIPTION OF THF DRAWING

FIG. 1 is a schematic diagram of the apparatus of the present invention.

DETAILED DESCRIPTION OF PREFERRED EMBODIMENTS OF THE INVENTION

Figure 1:
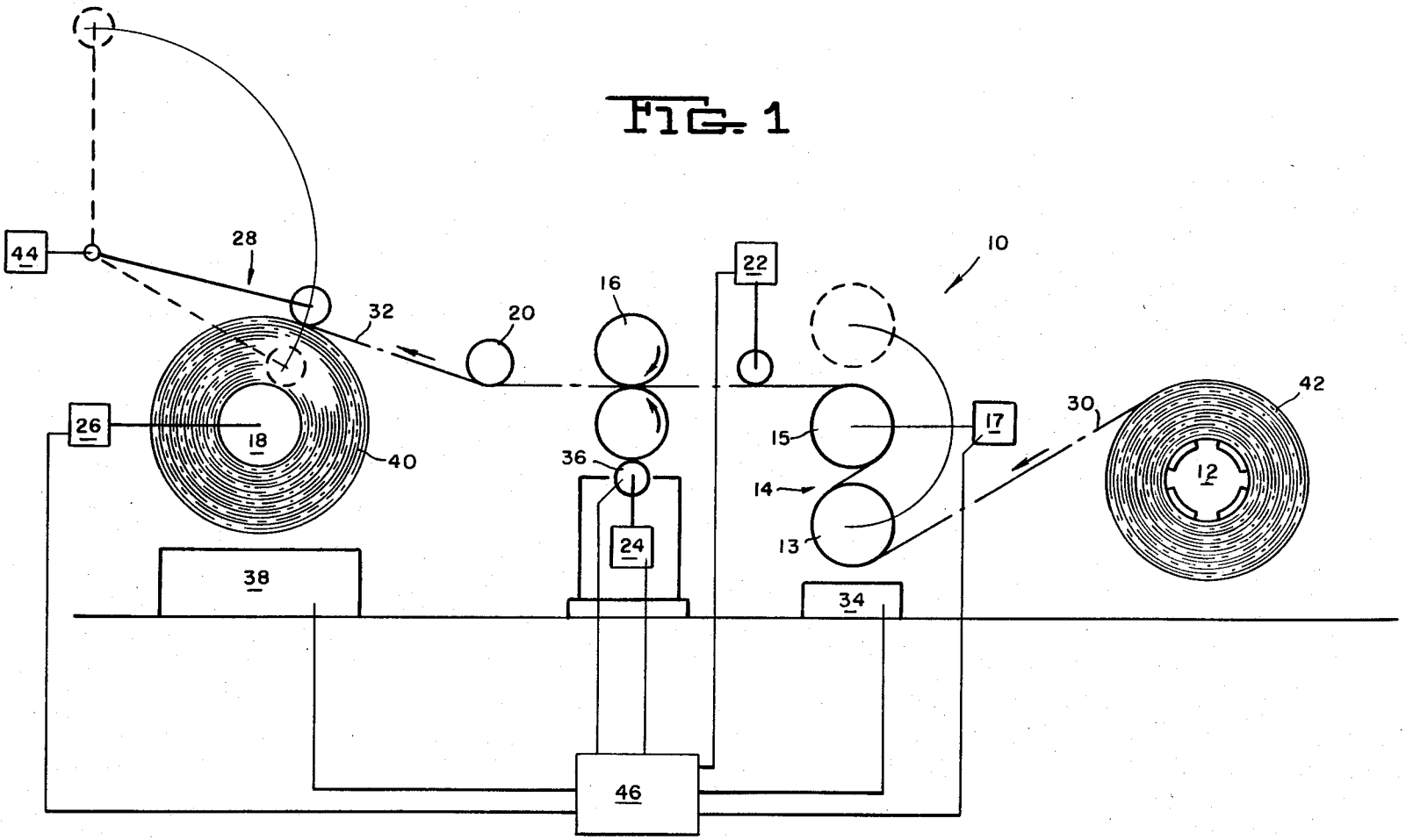

FIG. 1 schematically illustrates the apparatus 10 of the present invention. Slitting apparatus 10 includes pay-off reel 12 for providing metal strip 30 from coil 42 to a drive roll means 14, a slitting means 16 and to a take-up winder 18 for being tightly wound into coils 40.

Pay-off reel means 12 may be of conventional types. Preferably, pay-off reel 12 has a minimum back tension capability in order that the strip 30 is not placed under extreme tension prior to entering into drive roll means 14.

Drive roll means 14 provides from frictional engagement of the strip for forwarding the strip through the drive roll means and toward the slitting means 16. Preferably, the drive roll means should be able to control the speed of the strip through the entire apparatus 10. Preferably, drive roll means 14 may consist of a two-roll bridle having a bottom roll 13 and a top roll 15 through which the strip 30 is threaded. Drive roll means 14 may be of a swing-roll design for facilitating easy threading of the strip through the roll means, and is driven by drive means 34 which is conventional and may be a DC motor. Drive roll means 14 also controls the speed of the strip through apparatus 10 and is the speed master of the apparatus 10.

The means for slitting 16 is driven in any conventional way, such as by a DC motor, and includes knives and other cutting devices which are conventional. Slitting means 16 is located after the driven roll means 14 and the speed of which is controlled through communication with the driven roll means. Preferably, the driving means 36 of slitter means 16 is speed-slaved (hereinafter defined) from the drive roll means 14.

Take-up winder means 18 is provided for winding coils of slit metal strip from the slitter means 16. Take-up winder means 18 is driven by a drive means 38, which may be a conventional motor, such as a DC motor. The speed of take-up winder 18 is controlled through the driven roll means 14. Preferably, it is speed-slaved from the drive roll means 14, much as in the same manner as slitter means 16 is speed-slaved from drive roll means 14. Preferably, take-up reel or winder means 18 may include slip cores as is presently used for further facilitating winding tight coils. Take-up roll means 18 may be provided with a constant overdrive condition of anywhere from 2 to 5% regardless of the line speed of the metal strip. The overdrive provides a controlled overspeed of the take-up winder means 18 to facilitate the desired or specified slippage of the slip cores. The overdrive condition assures that the operator of apparatus 10 will not overspeed the take-up rolls which may put an extreme torque load on the slip cores of take-up winder means 18.

By the term speed-slaved, it is meant that drive means 38 of take-up winder means 18 will follow drive means 34 of drive roll means 14 over a full range of speeds to provide the necessary synchronization of apparatus 10. Such communication also results in synchronization of strip 30 travel distance with the travel distance of knives of slitting means 16.

Apparatus 10 may include a pass-line roll 20 interposed between slitter means 16 and take-up winder means 18 to maintain a constant pass-line location from the slitter means 16 during buildup of the coils 40 on take-up winder means 18.

Apparatus 10 may also include a conventional over-arm separator 28 for the purpose of guiding individual slit metal strips 32 to facilitate winding straight coils 40 and separation of those coils. Such a separator is feasible even with light gauge strip metal because of the tighter coils being wound as a result of the present invention. The position of the over-arm separator 28 is usable for changes in the speed of take-up winder means 18 to compensate for the increasing size or buildup of the coil 40 of slit strip material 32 on take-up winder means 18. Over-arm separator 28 may be of a conventional type connected to or communicating with a potentiometer 44 for speed compensation of take-up winder means 18.

Slitting apparatus 10 includes means for measuring the speed of strip 30, slitting means 16, and take-up winder means 18. The measured speeds are used for control of the speeds of each for overall tension control.

Slitting apparatus 10 also includes means 46 for controlling the speed of the strip 30, the slitting means 16 and take-up winder means 18 through communication with driven roll means 14 for providing a predetermined synchronization as it passes through slitting means 16 and for winding coils 40 of slit strip 32 on take-up winder means 18 at a predetermined overspeed.

The means for measuring speed and controlling speed preferably includes pulse generators 22 and 24 and tachometer-generators 17 and 26. Pulse generator 22 is associated with slitting means 16 and is located between drive roll means 14 and slitting means 16. Preferably, pulse generator 22 is driven directly from the moving strip 30. A pulse generator 24 is associated with slitting means 16 and may be driven from the slitting means, such as from the outside diameter of the moving knives or cutters of slitting means 16. The pulse generators 22 and 24 measure the speed and/or travel distance of the strip before slitting and the speed and/or travel distance of the slitting through slitting means 16. Preferably, the signals from pulse generators 22 and 24 are compared and variations are used to control the speed and/or travel distance of the strip and slitter means 16. Preferably, the signals from generators 22 and 24 are identical, which indicates that there is no skidding or slippage occurring between the knives of slitting means 16 and moving strip 30. Variations between the signals can be used as a forced feedback signal to make corrections to the drive means 36 for slitting means 16. Such control may increase or decrease the speed and/or travel distance of the knives or cutting devices of slitting means 16.

There may also be conditions when the signals from pulse generators 22 and 24 may be used to control drive means 36 for operating the slitting means 16 a fraction of a percent faster or slower than the moving strip 30. A vernier control in the electric circuit, including pulse generators 22 and 24, can accomplish such control.

Drive means 38 for take-up winder means 18 may have a tachometer-generator 26 associated for controlling the speed of take-up winder means 18. Tachometer-generator 26 may be speed-slaved from drive roll means 14 through tachometer-generator 17 associated with drive means 34 of drive roll means 14.

The communication for speed control of slitter means 16 and take-up winder means 18 with driven roll means 14 is an important feature of the present invention. Such communication includes speed control of apparatus 10 over the full range of speeds in conjunction with speed and/or travel distance control of slitting means 16. Such communication provides take-up winder means 18 being speed-slaved from drive roll means 14.

In an operation of slitting apparatus 10 of the present invention, a coil metal strip 30 is provided for slitting. Strip 30 is threaded through the two-roll bridle of drive roll means 14, through slitter means 16, adjacent pass-line roll 20 and engaged with take-up roll means 18. Through drive means 34, the strip 30 is driven forward through drive roll means 14 and has the speed controlled through frictional engagement with strip 30. Drive means 36 further drives strip 30 through slitting means 16 for slitting the strip under tension. Pulse generators 22 and 24 generate signals which are compared for controlling the relative speed of slitting means 16. Drive means 38 causes take-up winder means 18 to rotate and drive the strip while winding tight coils of strips 32. Tachometer-generator 26 can further control the speed of take-up winder means 18, as well as over-arm separator 28 which compensates for speed due to buildup of the coils 40 of slit strip 32. Pulse generators 22 and 24 and tachometer generators 17 and 26 measure the speed of the strip before slitting, the speed of slitting and the speed of winding the coils of slit strip, thus controlling the driving speed of each of those as a function of the driving speed for providing a predetermined speed during slitting. Tension of the strip through slitting means 16 is controlled by the slip cores of take-up winder means 18 and the pressure applied to the strip.

While several embodiments of the invention have been shown and described, it will be apparent to those skilled in the art that modifications may be made therein without departing from the scope of the present invention.

What is claimed is:

1. An apparatus for longitudinally slitting metal strip comprising:

(a) driven roll means for frictionally engaging and forwarding the strip, said means controlling the speed of the strip through the apparatus;

(b) means for driving said driven roll means;

(c) means for slitting the strip under tension, said means located after the driven roll means;

(d) means for driving said slitting means;

(e) take-up winder means for winding coils of slit metal strip thereon;

(f) means for driving said take-up winder means;

(g) means for separately measuring the speed of the slitting means, driven roll means and take-up winder means and the speed of the strip before the slitting means; and (h) means for controlling the speed of the strip and slitting means separately from the take-up winder means and driven roll means for providing a predetermined speed of the strip as it passes through said slitting means under tension, said controlling means includes having the means for driving the take-up winder means speed-slaved from the driven roll means, and said controlling means includes having the means for measuring the strip speed in communication with the means for measuring the speed of the slitting means for separately comparing the strip speed and speed of said slitting means and adjusting the speed of the slitting means as a function of the comparison.

2. The apparatus as set forth in claim 1 wherein the means for controlling the speed includes a tachometer-generator associated with each of the take-up winder means and drive roll means and a pulse generator associated with each of the slitting means and the moving strip before the slitting means.

3. The apparatus as set forth in claim 1 wherein the driven roll means includes a two-roll bridle.

4. The apparatus as set forth in claim 1 wherein said take-up winder means includes slip cores for facilitating winding tighter coils.

5. The apparatus as set forth in claim 1 further including a pass-line roll device between said slitting means and said take-up winder means.

6. The apparatus as set forth in claim 1 further including a pay-off reel means for providing metal strip to said driven roll means with minimal back-tension.

7. The apparatus as set forth in claim 1 wherein associated with the take-up winder means is a device to compensate for speed changes in the take-up winder means for increasing coil size.

8. A method for longitudinally slitting metal strip comprising:

(a) providing metal strip;

(b) driving the strip forward and controlling the speed thereof by frictional engagement therewith;

(c) slitting the strip under tension;

(d) winding coils of slit strip while still further driving the strip;

(e) separately measuring the speed of the strip before slitting, the speed of slitting, the speed of driving the strip and the speed of winding the coils of slit strip; and (f) controlling the speed of winding the strip as a function of the driving speed and separately controlling the strip speed and speed of slitting by comparing the speed of each and adjusting the speed of slitting as a function of the comparison for providing a predetermined tension during slitting and for winding tight coils of metal strip.

* * * * *